US006165323A

United States Patent [19]

Shearer

[11] Patent Number: 6,165,323

[45] Date of Patent: Dec. 26, 2000

[54] SCREEN PLATE HAVING A PLURALITY OF INCLINED SLOTS IN A DIGESTER

[75] Inventor: Jay K. Shearer, Hudson Falls, N.Y.

[73] Assignee: Andritz-Ahlstrom Inc., Glen Falls, N.Y.

[21] Appl. No.: 09/248,005

[22] Filed: Feb. 10, 1999

[51] Int. Cl.[7] ..... D21C 7/00; D21D 5/16

[52] U.S. Cl. ..... 162/251; 210/498; 210/499

[58] Field of Search ..... 162/251; 210/499, 210/498

[56] References Cited

U.S. PATENT DOCUMENTS

| | | | |
|---|---|---|---|
| 2,998,064 | 8/1961 | Lang | 162/251 |
| 3,711,367 | 1/1973 | Christenson | 162/251 |
| 3,713,541 | 1/1973 | Nelson | 210/415 |
| 4,593,612 | 6/1986 | Rieger | 99/277.2 |
| 4,795,560 | 1/1989 | Chupka et al. | 162/251 |
| 5,234,550 | 8/1993 | Ekholm et al. | 162/251 |
| 5,236,554 | 8/1993 | Greenwood | 162/251 |
| 5,310,482 | 5/1994 | Sather | 210/485 |
| 5,744,005 | 4/1998 | Carlsson et al. | 162/251 |
| 5,914,032 | 6/1999 | Kemp et al. | 210/85 |

FOREIGN PATENT DOCUMENTS

WO 95/16817 6/1995 WIPO .

WO 96/26315 8/1996 WIPO .

*Primary Examiner*—Steve Alvo

*Attorney, Agent, or Firm*—Nixon & Vanderhye P.C.

[57] ABSTRACT

A screen assembly particularly adapted to be used in a continuous or batch digester in the production of cellulose (chemical) pulp utilizes a particular screen plate construction that enhances productivity while minimizing blockage of the screen slots (and subsequent non-uniformities in the pulp produced when the screen is blocked). A screen plate having a convex outer surface and concave inner surface (substantially an arc of between 20–60 degrees) is pivotally connected for movement about a vertical axis on one side edge to frame mounted in the digester. The screen plate has a plurality of slots (e.g. 2–13 mm wide) machined in it, and the screen plate is positioned in the digester so that the inclination angle of the slots relative to the horizontal or vertical is between 30–60 (e.g. about 45) degrees. A plurality of land areas are provided between regions of the slots in screen plate. A plurality of support pins may be connected (e.g. welded) to the screen plate outer surface and extend outwardly from it. The support pins in different land areas are offset from each other and may be disposed in an imaginary straight line that make an angle substantially the same as the angle of the slots with respect to the horizontal or vertical. Preferably the slots taper outwardly at the outer surface at an angle of between about 10–60 (e.g. about 30) degrees.

31 Claims, 8 Drawing Sheets

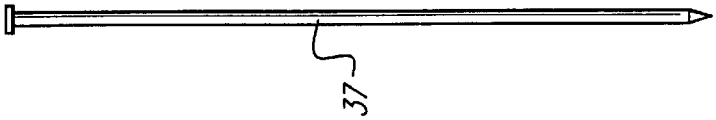
Fig.8
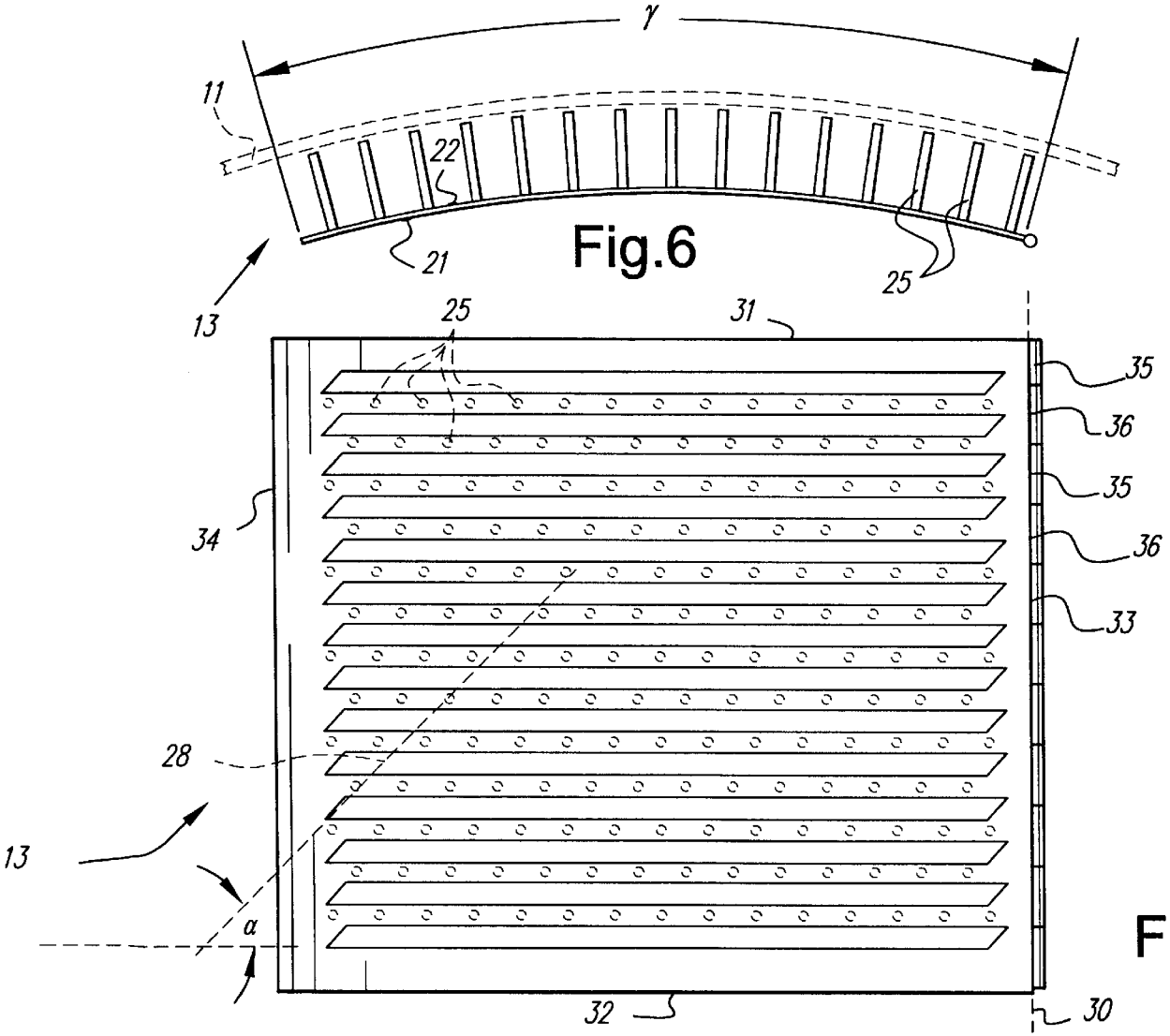
Fig.7
Fig.6

SCREEN PLATE HAVING A PLURALITY OF INCLINED SLOTS IN A DIGESTER

BACKGROUND AND SUMMARY OF THE INVENTION

The screen plates used in conventional digesters for the production of chemical cellulose pulp (e.g. kraft pulp), both continuous and batch digesters, but particularly in continuous digesters, have been a source of downtime and inadvertently introduced non-uniformities in the pulp produced for many years. Despite a wide variety of attempts at particular screen design, and alternating between what screens liquid is withdrawn from (particularly in the extraction stage of a continuous digester, but also in cooking and washing stages), the screens continue to be a source of problems.

In published international application WO 96/26315 (the disclosure of which is hereby incorporated by reference herein) a significant advance in screen plate design was provided by utilizing a plurality of bars, or machined openings in a plate, to provide slots that are disposed at an angle of inclination of between about 30–60 degrees (preferably about 45 degrees) with respect to the horizontal when utilized in a digester. The preset invention provides an improvement in the screen design in WO 96/26315 that even further enhances screen functionality, and ease of construction, while minimizing blockage.

According to one aspect of the present invention a screen used in the production of cellulose pulp in a digester (e.g. a continuous or batch digester, but particularly a continuous digester) is provided comprising: The screen comprising a frame, and a metal screen plate secured to the frame, the screen plate having a plurality of slots formed therein. The screen plate positioned in the digester so that the slots have an inclination angle $\alpha$ relative to the horizontal or vertical is between about 30–60 degrees. And, wherein a plurality of (substantially horizontally, vertically, and/or diagonally extending) land areas are provided between regions of the slots in the screen plate. Preferably the slots are machined in the screen plate. The screen plate preferably comprises an inner surface facing the inside of the digester and for engaging cellulosic fibrous material slurry in the digester; and an outer surface; and further comprises a deflection minimizing means, preferably a plurality of metal support pins connected to the screen plate outer surface and extending outwardly therefrom. The support pins may have any cross-sectional configuration (e.g. circular, quadrate, triangular, etc.) and typically extend into contact with the digester outer shell so as to provide their support function, and preferably are welded to the screen plate. The metal support pins connected to consecutive land areas are preferably offset from each other, in fact so that in different land areas the pins are disposed on an imaginary straight line that makes an angle of about a with respect to the horizontal or vertical. In the preferred embodiment the angle $\alpha$ is about 45 degrees.

Preferably the frame is part of the digester, connected to the digester outer shell, and the screen plate is pivotally connected to the frame so that the screen plate may be pivotally moved away from the frame. Typically the screen plate has first and second sides, and is pivotally connected to the frame along a substantially vertical axis at the first side of the screen plate.

In the preferred embodiment, the slots formed on the screen plate taper outwardly at the outer surface (e.g. from the inner surface to the outer surface or from a point with the plate to the outer surface) at an angle $\beta$ of between about 10–60 degrees, preferably about 20–40 degrees, most preferably about 30 degrees. The digester has a radius at the screen, and the inner and outer surfaces preferably have a radius of curvature approximately equal to the radius of the digester (slightly less than the radius of the out shell).

Preferably substantially all of the slots in a particular screen plate have the same inclination angle $\alpha$, although it may be with respect to a side edge of the screen plate rather than the top or bottom edge. Alternatively, some (typically a third or less) of the slots in a particular plate may have substantially vertical or horizontal orientations, instead of the angle $\alpha$.

According to another aspect of the present invention a screen plate per se is provided comprising: A substantially quadrate (e.g. square or rectangular) piece of metal having substantially parallel top and bottom edges, and substantially parallel first and second side edges (substantially perpendicular to the top and bottom edges). A plural slots formed in the piece of metal. The slots having an inclination angle $\alpha$ relative to one edge of between 30–60 degrees and a width of between about 2–13 mm, preferably about 3–9 mm. And, a plurality of land areas provided between regions of the slots in the piece of metal. The plate is preferably curved and has an are of between about 20–60 degree The details of the screen plate per se preferably are as described above.

It is the primary object of the present invention to provide an enhanced screen structure for use with digesters in the production of chemical cellulose pulp. This and other objects of the invention will become clear from an inspection of the detailed description of the invention and from the appended claims.

BRIEF DESCRIPTION OF THE DRAWINGS

FIG. 6 is a top view of one of the screen plates of FIG. 1, clearly illustrating the hinge and support pins which are preferably associated therewith;

FIG. 7 is a front view of the screen plate of FIG. 6;

FIG. 8 is a side view of the hinge pin utilized with the screen plate of FIGS. 6 and 7;

DETAILED DESCRIPTION OF THE DRAWINGS

Figure 1:
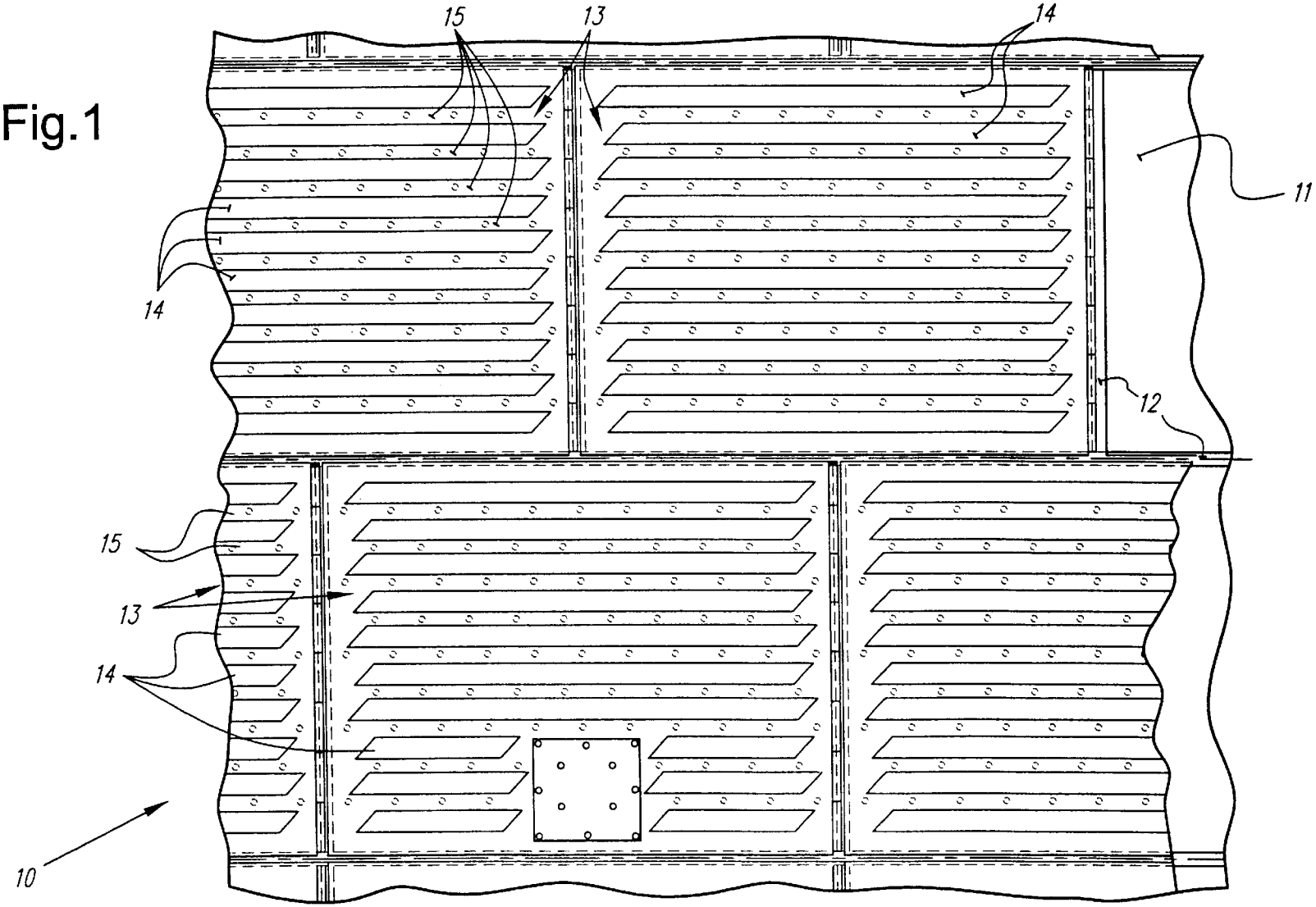
FIG. 1 is a front view of a plurality of screens in a screen assembly according the present invention, located inside of a continuous digester.

FIG. 1 schematically illustrates, from the inside of a digester, particularly a continuous digester, a plurality of screens in a screen assembly utilized in the extraction section of the digester. The entire screen assembly is illustrated generally by reference numeral 10, while the digester, particularly the outer shell thereof, is illustrated at 11 in FIGS. 1 and 6. The digester 11 is a conventional digester, typically being upright at circular in cross-section, having an inlet for comminuted cellulosic fibrous material (such wood chips) at the top, and an outlet for produced chemical cellulose pulp (e.g. kraft or sulfite pulp) at the bottom. The digester typically includes extraction, cooking, and washing zones, and screen assemblies, such as the assembly 10, are typically provided in each those zones. While the screen assembly 10 according to the present invention is particularly applicable to extraction screens adjacent the top of a continuous digester, it also may be applicable to the cooking or washing zones of some digesters.

The screen assembly 10 comprises a plurality of screens each of which comprises a frame 12 and a metal screen plate 13. The frame 12 in the embodiment illustrated in FIG. 1 comprises metal bars, angle irons, or like structural elements which, in this case, are connected directly to the digester 11 outer shell, although as shown in WO 96/26315 the frame 12 may be distinct from the digester 11, and rather connected to the digester in a releasable manner.

The metal screen plate 13 according to the present invention has a plurality of slot regions which are illustrated only schematically at 14 in FIGS. 1 and 7, with generally horizontally extending land areas 15 between the groups of slot regions 14. The slots 17 of the slot regions 14 per se typically have the configuration of WO 96/26315 (which has been incorporated by reference herein) in that (see FIGS. 2 and 3) they make an angle $\alpha$ of between about 30–60 degrees (e.g. about 45 degrees) with respect to the horizontal vertical, and have the spacing therebetween disclosed in WO 96/26315. However unlike the construction in WO 96/26315, according to the present invention the slot regions 14 are interrupted by the land areas 15.

Figure 3:
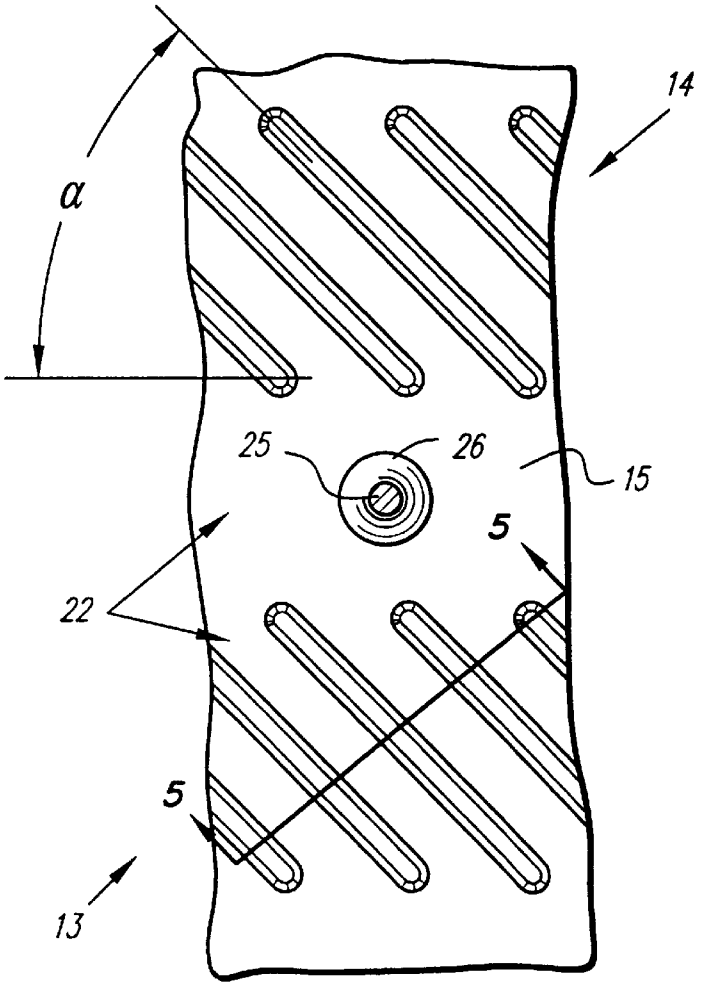
FIG. 3 is a view like that of FIG. 1, only of the outer surface of the screen plate.
Figure 2:
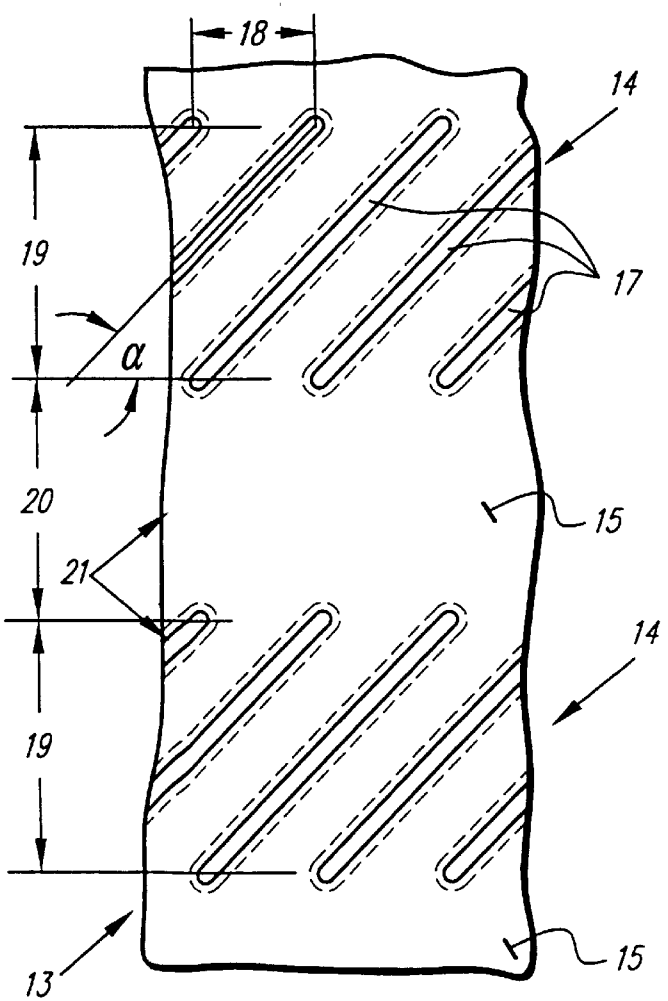
FIG. 2 is a detail view of the inner surface of one of the screen plates of the assembly of FIG. 1 illustrating particular machined slots provided therein, with land areas between the slots.

As seen in FIGS. 2 and 3, each of the individual machined slots 17 of the schematically illustrated slot regions 14 make an angle $\alpha$ with respect to the horizontal or vertical, which is between 30–60 degrees, preferably about 45 degrees as illustrated in FIGS. 2 and 3. Each of the slots 17 is spaced from the adjacent slot a horizontal distance 18 (see FIG. 2), which may be about 0.75–1.5 inches, e.g. about one inch. Each of the slot regions 14 has a vertical dimension 19 which is about 1.5-three times the spacing 18 between the slots 17, e.g. the spacing 19 being about two inches in the embodiment illustrated in FIG. 2. The land areas 15 have a vertical dimension 20, which preferably is approximately equal to the dimension 19, e.g. about two inches in the embodiment illustrated in FIG. 2. Preferably dimensions 19 for each of the slot regions 14 and the dimensions 20 for the land areas 15 are substantially the same in any particular screen plate 13, although under some circumstances they may vary. Also, preferably the angle $\alpha$ is the same for all the slots 17 from one slot region 14 to the next, although again there may be variations from region to region. Also preferably all of the slots 17 within given screen plate 13 have the same orientation, but from one screen plate 13 to the next, vertically, the slots 17 may have opposite orientations (that is for one screen plate 13 slots 17 may slant up left to right from top to bottom, and the other right to left from top to bottom).

Figure 4:
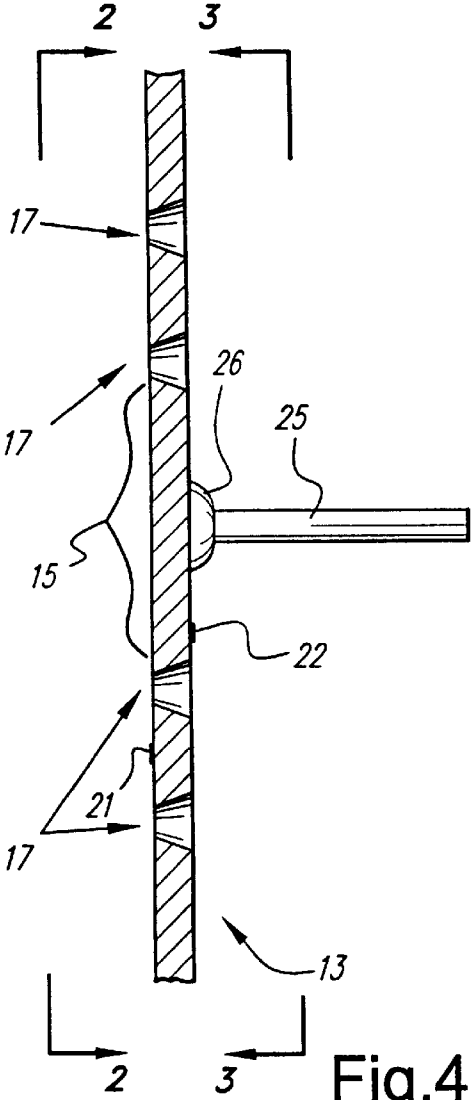
FIG. 4 is a longitudinal cross-sectional view of the screen plate of FIGS. 2 and 3, illustrating by arrows 2—2 and 3—3 where the views of FIGS. 2 and 3 are take.

As seen in FIGS. 2 through 5, the slots 17 may flare outwardly from where the liquid enters to where the liquid exits. That is each screen plate 13 has an inside face, face 21 visible in FIG. 2, and an outside face 22, the face visible in FIG. 3. The comminuted cellulosic fibrous material in a liquid slurry engages the face 21, while the liquid is withdrawn, for example, by conventional pumping equipment connected up to the volume adjacent the outer face 22, from the outer face 22. As seen in FIG. 4, and more clearly in FIG. 5, the side edges 23 defining each of the slots 17 make an angle $\beta$ (see FIG. 5) with respect to each other at the outer face 22. The width 24 (see FIG. 5) of each of the slots 17 at the inner surface 21 preferably is between about 2–13 mm, preferably between about 3–9 mm. The angle $\beta$ is preferably about 20–40 degrees, e.g. about 30 degrees. The plate 13 thickness (distance between surfaces 21 and 22 in FIG. 5) is between about ⅛–½ inch, preferably about ¼–⅜ inch.

As seen in the top view of FIG. 6, each of the screen plates 13 preferably is curved so that the inner surface 21 is concave and the outer surface 22 is convex. The radius of curvature of the screen plate 13 will depend upon the dimensions of the digest 13, but typically the radius of curvature of the screen plate 13 concave and convex surfaces 21, 22, respectively, is approximately the same as the radius of curvature of the digester outer shell 11 at that point of the digester 11, e.g. on the order of 5–20 feet, typically 7–15 feet. Each screen plate 13 may have an arcuate extent $\gamma$, which of course is dependent upon the radius of the digester 11, how many screen plates 13 it is desirable to have at any particular place, and other factors. However the angle $\gamma$ preferably is between about 20–60 degrees, e.g. about 30 degrees for the particular embodiment illustrated in FIG. 6.

In order to provide effective support for each of the screen plates 13, preferably a plurality of support pins, which are seen in solid line generally by reference numeral 25 in FIGS. 3, 4, and 6, are provided. The pins 25 are preferably of metal, such as steel, interconnected (e.g. by welds 26—see FIGS. 3 and 4) to the outer surface 22 of each screen plate 13 at the land areas 15. The support pins 25 are shown in clotted line in FIGS. 1 and 7. The support pins 25 may have ally desired cross-sectional configuration, such as round, quadrate (e.g. square or rectangular), triangular, etc., and are as long as the width of the annular space between the screen plates 13 and the digester 11 shell, e.g. typically about 6–12 inches. The centers of the pins 25 typically spaced from each other horizontally a distance of about 4–5 inches (e.g. about 4 ½ inches). The pins 25 abut against the inner face of the digester 11 (see FIG. 6) when the screen plate 13 is pivoted to the closed position.

The pins 25 are typically disposed —as seen in FIGS. 1 and 7 —so that in consecutive land areas 15 they are offset from each other. For example as illustrated in FIG. 7, each pin 25 of one land area 15 is located in the center of pins 25 in the next land area 15, meaning that where the angle $\alpha$ is 45 degrees, the support pins 25 in different land areas 15 are disposed in an imaginary straight line 28 (see FIG. 7) that makes the angle of about $\alpha$ with respect to the horizontal or vertical.

The function of the pins 25—supporting the screen plate 13 against deflection—may also be provided by other means. For example, the thickness of the screen plate can be increased (e.g. to above ½ inch), or horizontal, vertical, or obliquely oriented support bars can engage the outer surface 22, so long as the flow of liquid is not significantly obstructed.

Another desired feature of the screen assembly 10 according to the present invention, to provide for enhanced serviceability, is to pivotally mount the screen plates for pivotal movement about a substantially vertical axis. That is for a screen plate 13 having a top edge 31, bottom edge 32, first side edge 33 (the right side of FIG. 7), a second side edge 34, the screen plate 13 is pivoted about the axis 30 adjacent the first side edge 33. Hinge elements 35, 36 are alternatively connected to the screen plate 13 and the frame 12, respectively. Each of the hinge elements 35, 36 has a hollow interior that receives the hinge pin 37 (see FIG. 8) therein. During normal operation, preferably the screen plate 13 is held to the frame 12 by bolts or tack welds (not shown), but when it is desired to service the area, the bolts can be removed and/or the tack welds broken, and the plate 13 pivoted about the axis 30.

Since in use the top 31 and bottom 32 edges of the screen plate 13 are substantially horizontal, the slots 17 make the angle α with respect to them.

Figure 5:
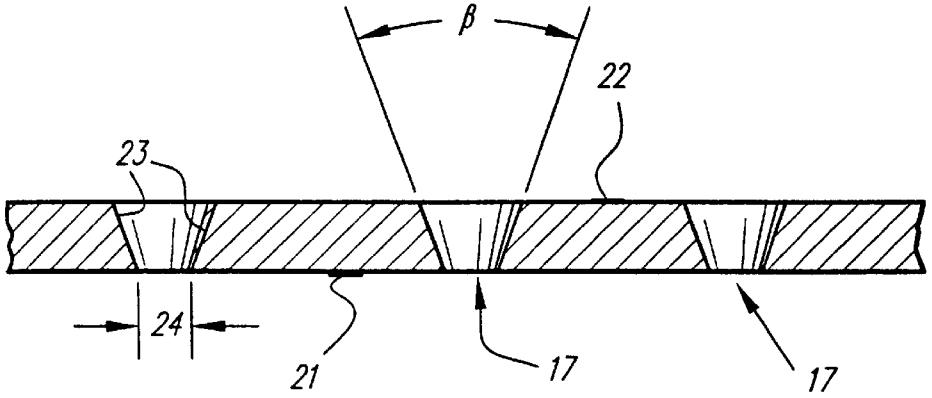
FIG. 5 is another even more detailed cross-sectional view of the screen plate of FIGS. 2–4 taken along lines 5—5 of FIG. 3 and illustrating the particulars of the slots in the screen plate.
Figure 9:
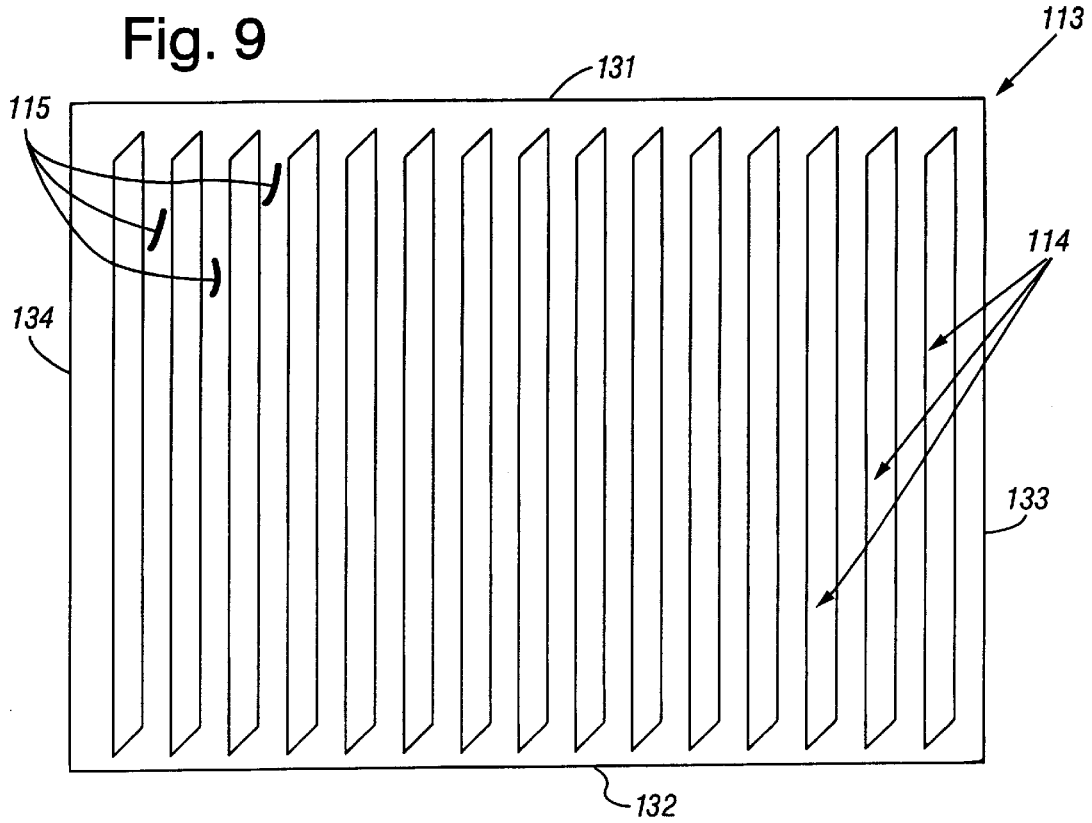
FIGS. 9 through 15 are schematic views generally like that of FIG. 7 but showing a number of different exemplary alternative configurations of the screen plate according to the present invention, particularly with respect to the positions and orientations of the slots and land areas.

In the embodiments of FIGS. 9 through 15 different configurations of the land areas and slots for exemplary screen plates according to the present invention are schematically illustrated. In FIG. 9 components comparable to those in FIG. 7 are shown by the same reference numeral only preceded by a "1", in FIGS. 10 and 14 components comparable to those in FIG. 7 are shown by the same reference numeral only preceded by a "2", in FIG. 11 the reference numerals for structures comparable those in FIG. 7 are preceded by a "3", in FIG. 12 components comparable to those in FIG. 7 have the same reference numeral only preceded by a "4", in FIGS. 13 and 15 components comparable to those in FIG. 7 have the same reference numeral only preceded by a "5", and in FIG. 16 components comparable to those in FIG. 5 are shown by the same reference numeral only preceded by a "2".

Figure 10:
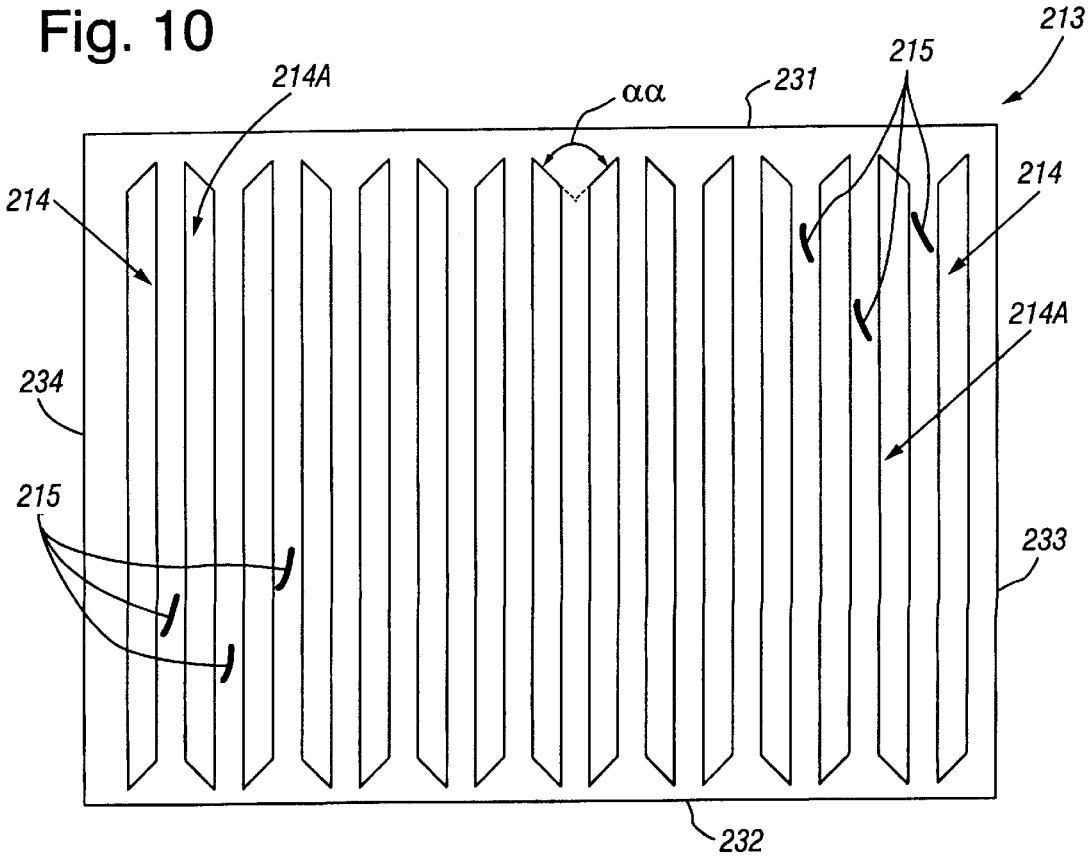

FIGS. 9 and 10 illustrate two examples of how the land areas 115, 215, respectively, may be substantially vertically extending on a screen plate 113, 213 having regions 114, 214, 214A of inclined slots. In FIG. 9, the inclined slots 114 are oriented at a 45 degree angle from the upper right to the lower left, though the slots 114 may also be inclined from the upper left to the lower right. FIG. 10 illustrates how the slot orientation can be varied within one plate, i.e. having slot regions 214, 214A such that a "herring bone" pattern is produced, e.g. with the angle αα substantially 90 degrees.

Figure 11:
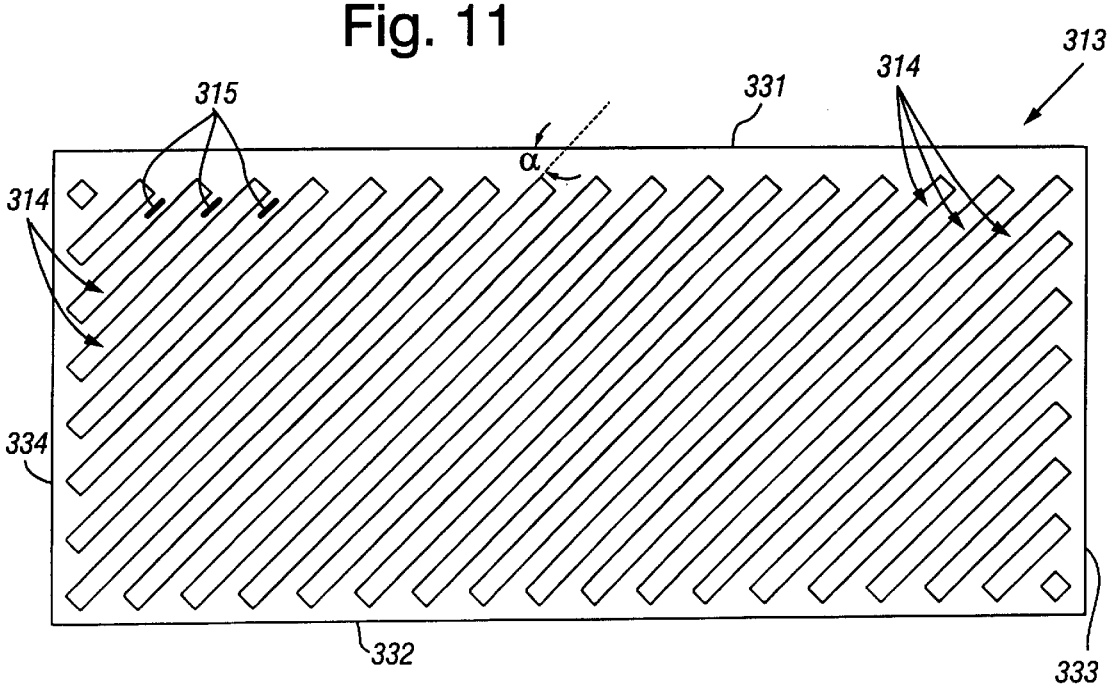

FIG. 11 illustrates how the land areas 315 may also be diagonal, that is, oriented at an angle other than a horizontal or vertical direction. In FIG. 11 the land areas 315 are oriented at about a 45 degree angle and the slot regions 314 are oriented at a 45 degree angle from the upper left to the lower right. Both these angles can be rotated 90 degrees, if desired, or at any other angle. That is, according to this invention, the angle of orientation of the slot regions 314 and/or the angle of orientation of the land areas 315 between the slots may vary from 5 to 85 degrees from the vertical, preferably from 30 to 60 degrees from the vertical.

Figure 12:
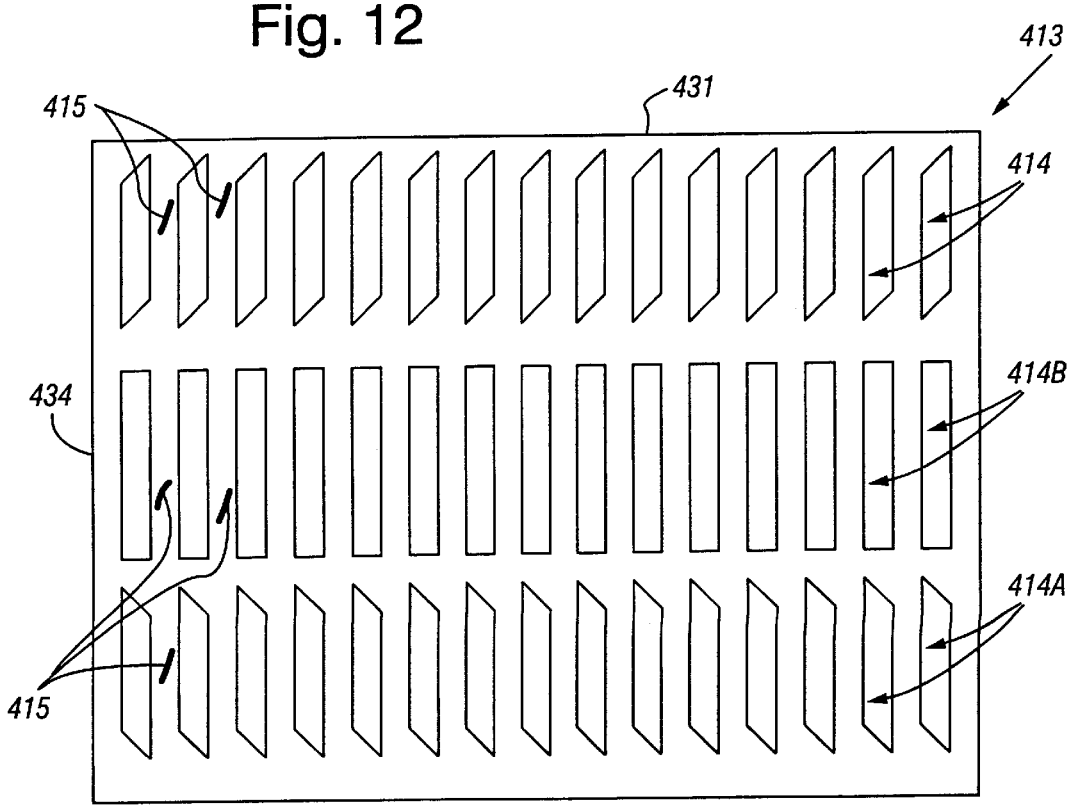
Figure 13:
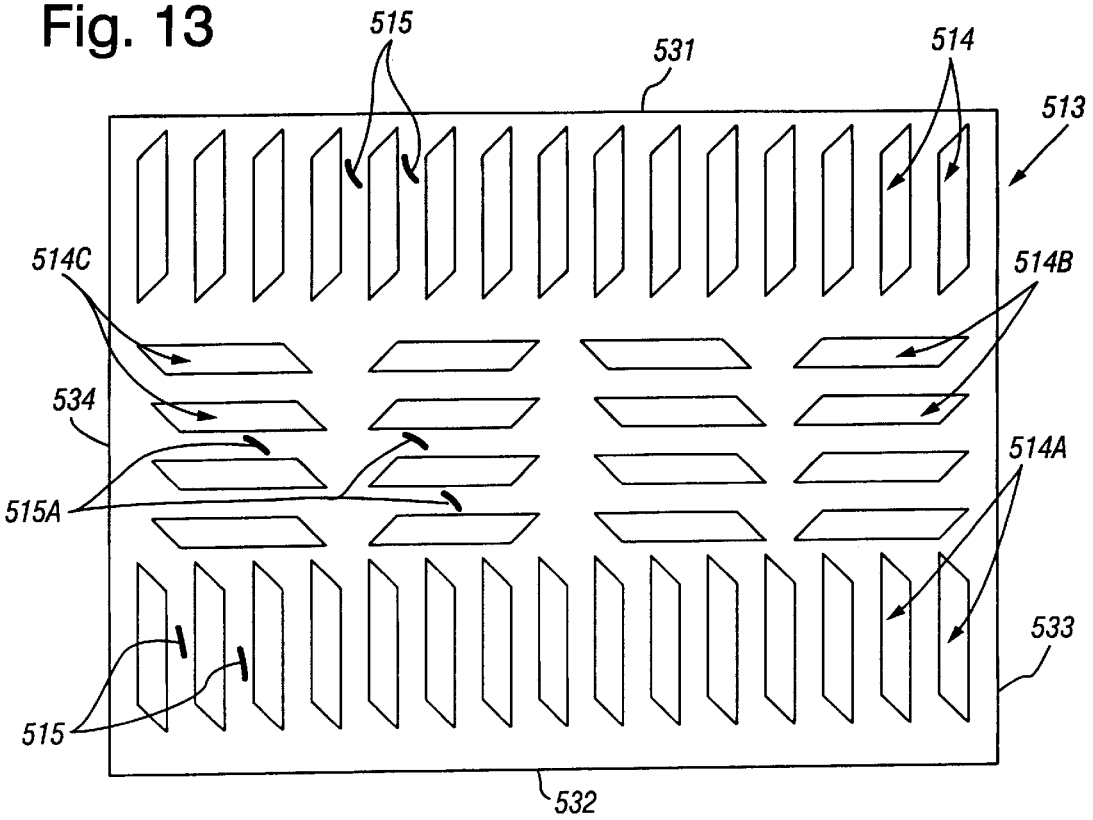
Figure 14:
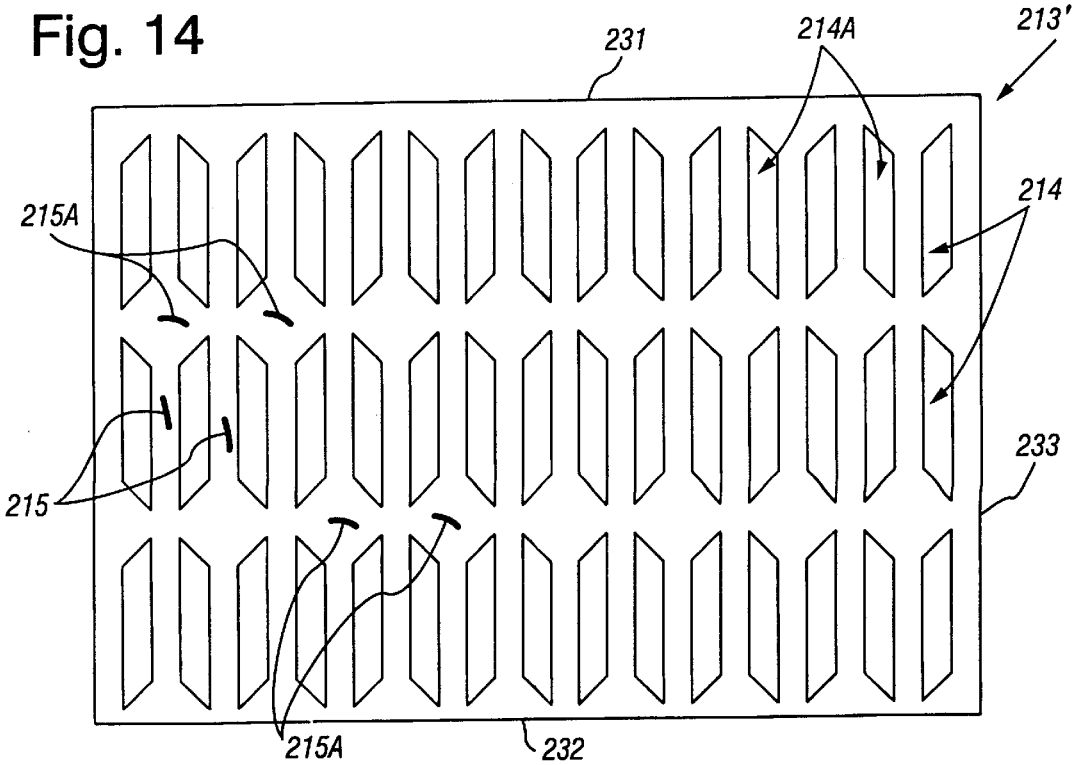

FIGS. 12 through 14 illustrate how slot regions 414, 414A, 414B, 514, 514A 514B, 514C, 214, 214A, in a screen plate 413, 513, 213' can be formed to create much more complex patterns of slot. FIG. 12 includes three rows of slot regions 414, 414A, 414B having different slot orientations. The upper row, 414, has substantially vertical land areas 415 between slots oriented at a 45 degree angle from the upper right to the lower left. The middle row 414B includes a row of slots that can comprise or consist of either long substantially vertical slots or short substantially horizontal slots. In the bottom row 414A, again, the slots are oriented at an angle α, similar to the top row, but at an angle rotated 90 degrees from the orientation of the top row. The order of the three rows 414, 414A, 414B may be varied in any way desired, for example, the slots in the top two rows may be oriented at an angle and the bottom row may comprise or consist of substantially horizontal or vertical slots.

FIG. 13 illustrates a screen plate 513 again having three rows of slot regions 514, 514A, and 514B and 514C. The upper row of slots 514 contains vertical slot regions separated by vertical land areas 515. Each slot section in the upper row has slots oriented at a 45 degree angle oriented from the upper right to the lower left. The middle rows of slots 514B, 514C contain rows of slotted areas having horizontal land areas 515A between rows. The slots in these slot sections are also oriented at a 45 degree angle but the slots orientation varies by 90 degrees in adjacent columns 514B, 514C of slotted areas. For example the left-most slotted column 514C contains 45 degree slots oriented from the upper left to the lower right. The column 514B to the right of the left-most column of slots contains slots having a 45 degree angle but oriented from the upper right to the lower left. The next two columns in the second row mimic the first two columns. The angle α of the slots and the number of rows and columns of slots may vary. The bottom row of slot regions 514A in FIG. 13 again have vertical land areas 515 as in the upper-most row shown, but the angle α of the slots is rotated 90 degrees from the slots shown in the first row. Again, the angle of orientation of the slots in the upper-most and the lower-most can also be the same or rotated 90 degrees to the orientation shown. Also, the position of the upper, middle, and lower rows of slots may be varied.

Figure 15:
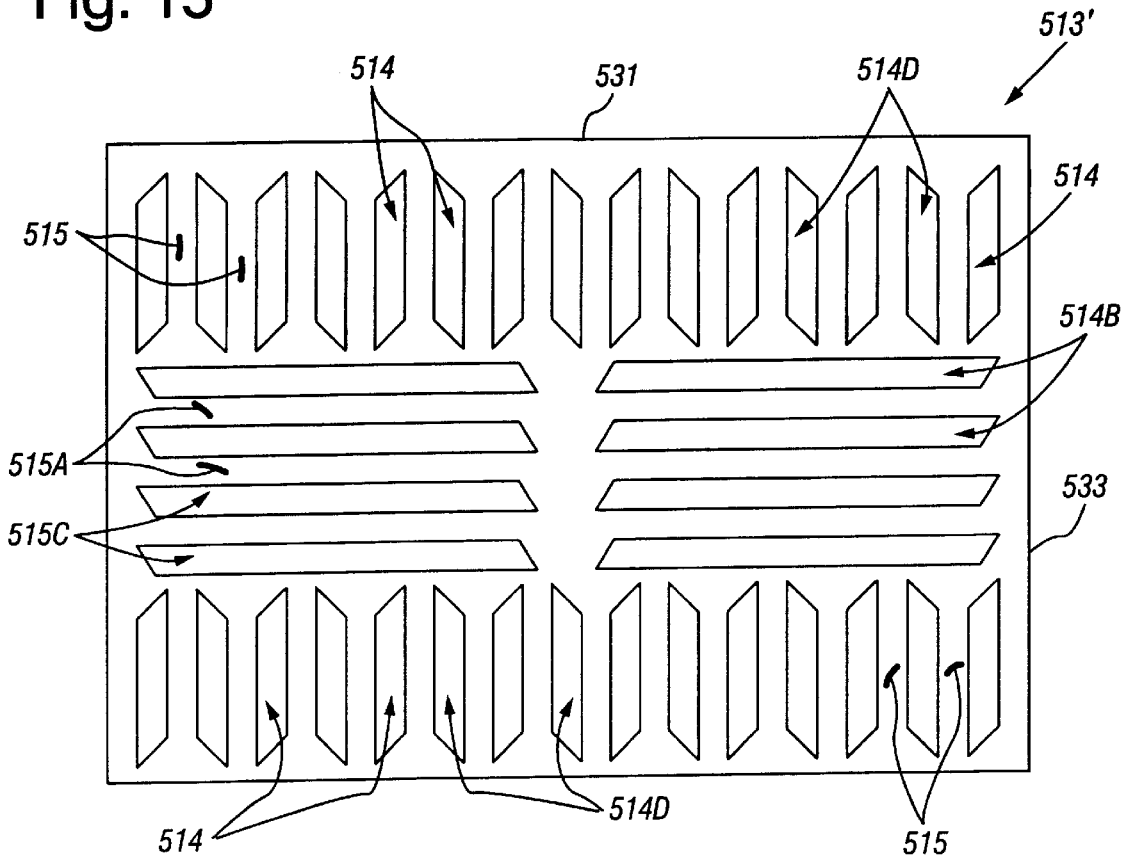

FIGS. 14 and 15 illustrate screen plates 213, 513' having further slot orientations according to this invention, which are modifications of those of FIG. 10 and 13, respectively, and are self-explanatory using the same conventions as in FIG. 9–13.

Thus a broad range of slot configurations which employ some form of the present invention—a digester screen plate 13, 213, 313, etc., having slots oriented in other than horizontal or vertical direction—can be contemplated.

Regardless of the orientation of the slot regions, in each of the FIGS. 9 through 15 embodiments, the slots (17) within any slot region (e.g. 114, 214A, 314, etc.) make an angle α of preferably between about 30–60 degrees (preferably about 45 degrees) with respect to one of the edges 131–134, 231–234, 331–334, etc. Although the particular edge that they make the angle α with respect to may change (e.g. the top or bottom edges 531, 532 for the slot regions 514, 514A in FIG. 13, and one of the side edges 533, 534 for the slot regions 514B, 514C in FIG. 13, etc.). The only exception to this is the slots 414B in FIG. 12 which are either substantially vertical or substantially horizontal.

Figure 16:
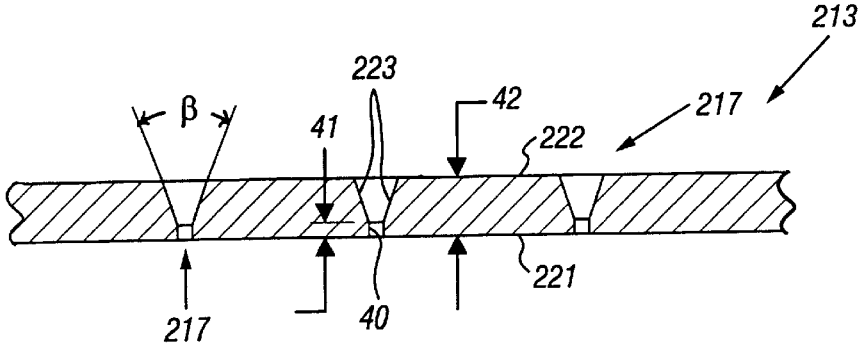
FIG. 16 is a view like that of FIG. 5 only illustrating a modification of the particular nature of the slots.

FIG. 16 illustrates a modification of the particular nature of the slots 17 of FIG. 5, the modified slots being shown at 217 in FIG. 16. The slanted walls 223 forming the angle β (between 10–60 degrees, preferably between 20–40 degrees, e.g. about 30 degrees), while making the angle β at the outer surface 222, start the slanted nature thereof a distance 41 from the surface 221, so that the slots 217 immediately adjacent the surface 221 have substantially parallel side walls, as indicated at 40 in FIG. 16. The thickness 42 of the plate 213 in FIG. 16 is the same as the thickness of the plate 13 in FIG. 5, i.e. preferably between about ⅛–½ inch, most preferably between ¼–⅜ inch.

The screen assembly 10, and screen plates 13, 113, 213, 313, etc., according to the present invention have enhanced operability in batch and continuous digesters, particularly continuous digesters, compared to conventional screens.

They are less susceptible to plugging, and have the other advantages associated with the screens in WO 96/26315, and additionally have enhanced strength, serviceability, ease of installation, and ease of manufacture, compared to the screens in WO 96/26315.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A screen used in the production of cellulose pulp in a digester having an internal surface;

said screen comprising a metal screen plate secured to said digester internal surface, said screen plate having individual slot regions wherein each region comprises a plurality of slots formed therein;

said screen plate positioned in said digester so that said slots have an inclination angle α relative to the horizontal or vertical of between about 30–60 degrees; and wherein a plurality of land areas are provided between the individual regions of said slots in said screen plate.

2. A screen as recited in claim 1 wherein said slots are machined in said screen plate, and wherein substantially all slots in said screen plate have said inclination angle α.

3. A screen as recited in claim 1 wherein said screen plate comprises: an inner surface facing the inside of said digester and for engaging cellulosic fibrous material slurry in said digester; and an outer surface; and further comprising means engaging said out outer surface for supporting said screen plate against deflection.

4. A screen as recited in claim 3 wherein said means engaging said outer surface comprises a plurality of metal support pins connected to said screen plate outer surface and extending outwardly therefrom.

5. A screen as recited in claim 4 wherein said support pins connected to consecutive land areas are offset from each other, and are welded to said screen plate.

6. A screen as recited in claim 5 wherein said support pins in different land areas are disposed in an imaginary straight line that makes an angle of about α with respect to the horizontal or vertical.

7. A screen as recited in claim 5 wherein substantially all slots in said screen plate have said inclination angle α.

8. A screen as recited in claim 3 wherein substantially all slots in said screen plate have said inclination angle α.

9. A screen as recited in claim 1, and wherein said screen plate is pivotally connected to said digester so that said screen plate may be pivotally moved away from said digester.

10. A screen as recited in claim 8 wherein said screen plate has first and second sides, and is pivotally connected to said digester along a substantially vertical axis at said first side of said screen plate.

11. A screen as recited in claim 10 wherein substantially all slots in said screen plate have said inclination angle α.

12. A screen as recited in claim 9 wherein substantially all slots in said screen plate have said inclination angle α.

13. A screen as recited in claim 1 wherein some of said land areas are substantially horizontally extending and some of said land areas are substantially vertically extending.

14. A screen as recited in claim 1 wherein said screen plate comprises: an inner surface facing the inside of said digester and for engaging cellulosic fibrous material slurry in said digester; and an outer surface; and wherein said screen plate is curved so that said outer surface is convex and said inner surface is concave about a vertical axis.

15. A screen as recited in claim 14 wherein said digester has a radius at said screen; and said inner and outer surfaces have a radius of curvature approximately equal to the radius said digester.

16. A screen as recited in claim 14 further comprising a plurality of support pins connected to said screen plate outer surface and extending outwardly therefrom; and wherein said slots taper outwardly at said outer surface at an angle β of between 10 –60 degrees.

17. A screen as recited in claim 14 wherein said land areas are substantially horizontally extending.

18. A screen as recited in claim 14 wherein said land areas are substantially vertically extending.

19. A screen as recited in claim 14 wherein said land areas are substantially diagonally extending.

20. A screen as recited in claim 14 wherein substantially all slots in said screen plate have said inclination angle α.

21. A screen as recited in claim 1 wherein said slots have a width of between about 2–13 mm, and wherein said metal plate has a thickness of between about ¼–⅜ inch.

22. A screen as recited in claim 21 wherein said screen plate comprises: an inner surface facing the inside of said digester and for engaging cellulosic fibrous material slurry in said digester; and an outer surface; and wherein said slots taper outwardly at said outer surface at an angle β of between about 20–40 degrees.

23. A screen as recited in claim 21 wherein substantially all slots in said screen plate have said inclination angle α.

24. A screen as recited in claim 23 wherein all of said slots have the same inclination angle α, and said inclination angle α is about 45°.

25. A screen as recited in claim 1 wherein said screen plate comprises: an inner surface facing the inside of said digester and for engaging cellulosic fibrous material slurry in said digester; and an outer surface; and wherein said slots taper outwardly at said outer surface at an angle β of between about 20–40 degrees.

26. A screen as recited in claim 25 wherein substantially all slots in said screen plate have said inclination angle α.

27. A screen as recited in claim 1 wherein substantially all slots in said screen plate have said inclination angle α.

28. A screen as recited in claim 27 wherein all of said slots have the same inclination angle α, and said inclination angle α is about 45°.

29. A screen as recited in claim 27 wherein said slots have a width of between about 2–13 mm, and said metal plate has a thickness of between about ⅛–½ inch.

30. A screen as recited in claim 27 wherein said slots have a width of between about 3–9 mm.

31. A screen as recited in claim 27 wherein said metal plate has a thickness between about ⅛ to ½ inch.

* * * * *

UNITED STATES PATENT AND TRADEMARK OFFICE

CERTIFICATE OF CORRECTION

PATENT NO. : 6,165,323
DATED : December 26, 2000
INVENTOR(S) : SHEERER

It is certified that error appears in the above-identified patent and that said letters patent is hereby corrected as shown below:

Title page, Item [57] ABSTRACT, line 10, add a after the word "to".

Column 1, line 55 (application page 2, line 7), change "a" to – α –.

Column 2, line 24 (application page 3, line 4), change "are" to – arc –.

Column 2, line 24 (application page 3, line 4), change "degree" to – degrees –.

Column 2, line 46 (application page 3, line 19), change "take" to – taken –.

Column 4, line 19 (application page 6, line 10), change "digest" to – digester –.

Column 4, line 36 (application page 6, line 23), change "clotted" to – dotted –.

Column 4, line 37 (application page 6, line 24), change "ally" to – any –.

Column 7, line 34 (application page 12, Claim 3, line 3), change "out" to – outer –.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*